United States Patent [19]

Lindsey et al.

[11] 4,220,235

[45] Sep. 2, 1980

[54] VENDING MACHINE CONTROL CIRCUIT INCLUDING CREDIT RELEASE RELAY

[75] Inventors: James C. Lindsey, Chattanooga; Gregory S. Morgan, Ooltewah, both of Tenn.

[73] Assignee: Cavalier Corporation, Chattanooga, Tenn.

[21] Appl. No.: 12,865

[22] Filed: Feb. 16, 1979

[51] Int. Cl.[3] ..... G07F 11/00

[52] U.S. Cl. ..... 194/10; 194/2; 221/225

[58] Field of Search ..... 194/2, 9 R, 9 T, 10; 221/125

[56] References Cited

U.S. PATENT DOCUMENTS

| | | | |
|---|---|---|---|
| 3,232,400 | 2/1966 | Henrickson | 194/2 |
| 3,278,079 | 10/1966 | Guard | 221/125 |
| 3,349,881 | 10/1967 | Camp | 194/10 |
| 3,486,601 | 12/1969 | Bowman | 194/10 |
| 3,529,707 | 9/1970 | Bowman | 194/10 |
| 3,540,562 | 11/1970 | Ptacek | 194/10 |
| 3,613,854 | 10/1971 | Bowman | 194/10 |
| 3,669,235 | 6/1972 | Breeden | 194/10 |
| 3,691,431 | 9/1972 | Hendrickson et al. | 194/10 X |
| 3,783,987 | 1/1974 | Hanert et al. | 194/10 |
| 3,836,046 | 9/1974 | Bowman | 194/10 X |
| 3,844,394 | 10/1974 | Hale et al. | 194/10 |
| 3,848,718 | 11/1974 | Bookout | 194/10 X |
| 3,924,719 | 12/1975 | Bowman | 194/10 |
| 3,924,779 | 12/1975 | Lindsey . | |
| 3,971,464 | 7/1976 | Seversen | 194/10 |
| 3,998,357 | 12/1976 | Levasseur . | |
| 4,044,877 | 8/1977 | Burton | 194/10 |
| 4,094,398 | 6/1978 | Camp et al. | 194/10 |

*Primary Examiner*—Robert J. Spar
*Assistant Examiner*—Edward M. Wacyra
*Attorney, Agent, or Firm*—Kerkam, Stowell, Kondracki & Clarke

[57] ABSTRACT

A vending machine control circuit which at relatively low cost effectively provides a lockout arrangement which ensures the delivery of only one article per money insertion and which allows alternate selection of articles when one selection is stalled or jammed. The circuit arrangement requires only two cam-operated switches per product selection, and has a single credit release relay common to all product selections. The credit release relay is energized when a vend relay is energized as the result of money insertion, and a time delay circuit is provided for maintaining energization of the credit release relay after the vend relay is de-energized near the beginning of a product vend cycle.

5 Claims, 1 Drawing Figure

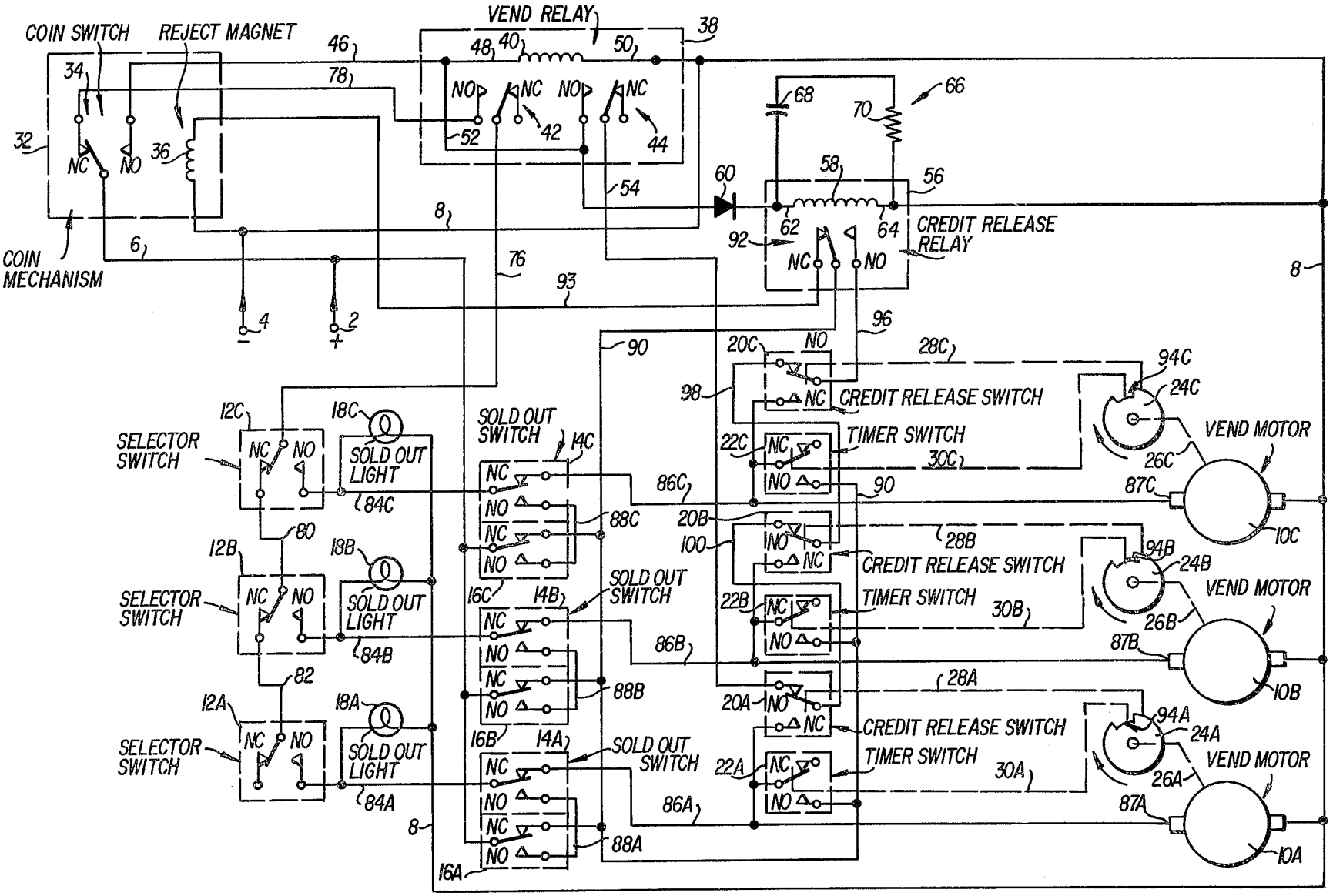
VEND MOTOR
VEND MOTOR
VEND MOTOR
CREDIT RELEASE RELAY
CREDIT RELEASE SWITCH
TIMER SWITCH
CREDIT RELEASE SWITCH
TIMER SWITCH
CREDIT RELEASE SWITCH
TIMER SWITCH
VEND RELAY
SOLD OUT SWITCH
SOLD OUT SWITCH
SOLD OUT SWITCH
SOLD OUT LIGHT
SOLD OUT LIGHT
SOLD OUT LIGHT
SELECTOR SWITCH
SELECTOR SWITCH
SELECTOR SWITCH
REJECT MAGNET
COIN SWITCH
COIN MECHANISM

VENDING MACHINE CONTROL CIRCUIT INCLUDING CREDIT RELEASE RELAY

BACKGROUND OF THE INVENTION

The present invention relates generally to a control circuit for a money operated vending machine for selectively dispensing articles from a plurality of sources and, more particularly, to such a vending machine control circuit including a lockout arrangement wich ensures delivery of only one article per money insertion and which allows alternate selection of articles when one selection is stalled or jammed.

Money operated vending machines for selectively dispensing articles, one at a time, from a plurality of sources are well known. Such vending machines generally comprise a plurality of stacks of articles which may be arranged in columns in side by side relationship. Upon insertion of the proper amount of money, such as deposit of a suitable coin, credit is established and a dispensing cycle is initiated according to a selection by the customer. In one particular type of machine, a vend motor is cycled during the dispensing cycle and causes a single article to be dispensed from the selected column or source.

Several features or operating functions are highly desirable in control circuits for such vending machines. Among these features are the provision of a lockout circuit which removes established credit at the proper time so as to ensure delivery of only one article per established credit and to allow alternate selection of articles which one selection is stalled or jammed. Particularly with respect to this alternate selection feature, one particular mechanical malfunction possible in a vending machine is a jamming or other mechanism failure in which one of the vend motors does not complete its cycle of operation and an associated cam-operated switch does not return to its resting condition. In such event, it is highly desirable that the machine not be fully disabled and that the remaining product selections remain operative.

It is of course desirable that these two features, as well as other features, be effectively provided with a minimum of circuit complexity, thus leading to better long term reliability and lower manufacturing cost. In efforts to provide these features, various circuits have been developed. Exemplary circuits for use in machines of the type wherein dispensing from each column is controlled by a vend motor which is arranged to be energized during the latter (vending) portion of its vend cycle through a timer switch are disclosed in the commonly-assigned Camp U.S. Pat. No. 3,349,881 and the commonly-assigned Bowman U.S. Pat. No. 3,486,601. For machines in which dispensing from each column is controlled by a vend solenoid, rather than by a vend motor, exemplary circuits are disclosed in the commonly-assigned Bowman U.S. Pat. No. 3,613,854, the commonly-assigned Bowman U.S. Pat. No. 3,836,046 and the commonly-assigned Bowman U.S. Pat. No. 3,924,719.

The circuits of the last three patents identified above are of additional interest for their use of a capacitor to hold a vend relay energized sufficiently long to enable completion of a customer selection by the vend solenoid after the customer-operable selector switch has been actuated.

A still further example of a vending machine control circuit is disclosed in the commonly-assigned Bowman U.S. Pat. No. 3,529,707, wherein both selection solenoids and a vend motor are employed.

Another lockout circuit for a multiple column vending machine is disclosed in Burton U.S. Pat. No. 4,044,877. In the Burton circuit, the desirable lockout features are provided by an arrangement in which each product selection actuating circuit includes three cam-operated switches actuated by a cam driven by the corresponding vend motor.

SUMMARY OF THE INVENTION

It is an object of the invention to provide a vending machine control circuit for a vending machine of the type which employs vend motors to effect product selection and which provides desirable functional features with a minimum of cost and complexity.

It is another object of the invention to provide such a vending machine control circuit which requires only two cam-operated switches for each product selection, thus minimizing the cumulative cost of these cam-operated switches, and which at the same time has minimal cost and complexity. This is especially important where a relatively large number of product selections, such as eight, are provided.

Briefly stated, and in accordance with one aspect of the invention, there is provided a control circuit for a vending machine of the type which has a plurality of article sources in the form of columns adapted to be selectively dispensed, and a plurality of vend motors, each vend motor corresponding to a separate column and arranged to dispense an article from the corresponding column when energized according to the choice of a customer. The circuit includes a conventional vend relay, a means for establishing a holding circuit for the vend relay upon energization thereof, and a vend switch connected to momentarily energize the vend relay upon insertion of money, for example a coin. A single credit release relay for the entire vending machine control circuit, and a means for energizing the credit release relay when the vend relay is energized are provided. There is a customer-operable selector switch for each article column. The selector switches are supplied with power when the vend relay is energized, and each selector switch is connected to energize the corresponding vend motor when the selector switch is operated while supplied with power.

Two cam-operated switches are provided for each vend motor and arranged to be actuated by the corresponding vend motor. The first of these cam-operated switches is a credit release switch which is actuated by its corresponding vend motor between a first and a momentary second position shortly after initial energization of the vend motor by the corresponding selector switch. Each credit release switch is supplied with power when the credit release relay is energized, and has contacts arranged in the first position to energize the vend relay holding circuit. In the momentary second position, each credit release switch has contacts arranged to momentarily interrupt the vend relay holding circuit and to energize the corresponding vend motor while the credit release switch is supplied with power. As a part of the arrangement which ensures delivery of only one article per vend switch operation, at least one of the credit release switches in its momentary second position interrupts the supply of power to at least one other credit release switch, which one other credit release switch possibly also is in its second position as a result of efforts by a customer to obtain two vended articles from only a single money insertion.

The second cam-operated switch for each vend motor is a timer switch arranged to be actuated by the corresponding vend motor from a first to a second position during the interval the corresponding credit release switch is in its momentary second position energizing the corresponding vend motor, and to be actuated from the second to the first position at the end of an article vend cycle. Each timer switch has contacts arranged in the second position to energize the corresponding vend motor and arranged upon return to the first position to de-energize the corresponding vend motor.

In order to maintain energization of the selected vend motor between the moment when the credit release switch switches to the momentary second position and interrupts the vend relay holding circuit and the moment when the timer switch switches to the second position and energizes the corresponding vend motor, there is provided a time delay means for maintaining the credit release relay energized for a predetermined time interval after the credit release switch interrupts the supply of power to the at least one other credit release switch and interrupts the vend relaying circuit to de-energize the vend relay. The predetermined time interval is at least long enough for the corresponding one timer switch to switch to its second position and energize the corresponding vend motor, and short enough such that the credit release relay is de-energized, thus removing the supply of power from all credit release switches, before the vend motor corresponding to the other one of the credit release switches which possibly is in its second position is energized sufficiently long to cause the corresponding other timer switch to switch to its second position in the event the other credit release switch is in its second position.

Briefly stated, and in accordance with another aspect of the invention, the time delay means comprises a storage capacitor connected in parallel with the coil of the credit release relay. Preferably, the vending machine control circuit further comprises an isolation diode connected between an energization terminal of the vend relay coil and an energization terminal of the credit release coil, such that the current flows through the diode to energize the credit release relay and charge the capacitor when the vend relay is energized, and the current flow from the capacitor to the vend relay coil is prevented when the vend relay is de-energized.

A conventional reject electromagnet may be provided which, when energized, permits the acceptance of money to actuate the vend switch and which, when de-energized, prevents the acceptance of money. In accordance with another aspect of the invention, there is provided a means for energizing the reject electromagnet when the credit release relay is de-energized.

To enhance the reliability of the protection afforded against delivering more than one article per vend switch operation, the arrangement of the selector switches is such that upon simultaneous customer operation of a plurality of selector switches, only one of the selector switches energizes its corresponding vend motor.

BRIEF DESCRIPTION OF THE DRAWING

While the novel features of the invention are set forth with particularity in the appended claims, the invention, both as to organization and content, will be better understood and appreciated, along with other objects and features thereof, from the following detailed description taken in conjunction with the drawing, in which:

The FIGURE is an electrical schematic circuit diagram of a vending machine control circuit according to the present invention.

DESCRIPTION OF THE PREFERRED EMBODIMENT

Since the inventive concept of the invention resides in the improved circuit and is substantially independent of the cabinet in which it is location or the means for delivery of the article which is dispensed, so long as vend motors are employed, the invention is herein described with reference only to the electrical schematic diagram of the FIGURE. By way of example, one particular vending machine cabinet in which the circuit of the present invention may be employed is disclosed in the commonly-assigned Lindsey U.S. Pat. No. 3,924,779, the entire disclosure of which is hereby incorporated by reference.

In the FIGURE, the present control circuit is illustrated in connection with a coin operated vending machine having three columns or sources of articles designated A, B and C. However, it will be apparent that as few as two or any greater number than three columns or article sources may be utilized and that the operating sequence for dispensing an article from each source is essentially the same. For convenience, each component in the operating circuit of one article column corresponding to a like component in the operating circuit of the other columns is designated in the FIGURE with a like numerical reference character (e.g., 10, 12, 14, etc.) followed by an alphabetical character (A, B or C) designating the particular column with which the component is associated. However, in the written description herein the numerical reference characters are generally employed alone and intended to refer collectively to the like components.

The illustrated circuit is adapted for operation from a single conventional twenty-four volt D.C. supply (not shown) connected to respective positive (+) and negative (−) supply terminals 2 and 4. However, with suitable component selection, the illustrated circuit may operate from an A.C. supply as well. For convenience, a line 6 which is supplied for the (+) terminal 2 is referred to herein as a "hot" conductor, and a line 8 which is supplied from the (−) terminal 4 is referred to herein as a "ground" or "return" conductor.

For effecting dispensing, each column has associated therewith a vend motor 10 which dispenses selected articles in a manner which is described in the above-incorporated Lindsey U.S. Pat. No. 3,924,779. (As noted above, in the nomenclature employed herein, since there is a separate vend motor for each article column the individual vend motors are designated 10A, 10B and 10C in the FIGURE.) For each vend cycle in which a single article is dispensed, the appropriate vend motor has a single 360° rotation before returning to a rest position.

For initial energization of the appropriate one of the vend motors 10, a customer operable selector switch 12 is associated with each article column. Other components associated with each article column, the connections to which are described in greater detail hereinafter, are a sold out switch having first and second double-throw sections 14 and 16 each arranged to be switched from the normally-closed (NC) position illustrated to the normally-open (NO) position upon exhaustion of the article supply in the corresponding column, a sold out light 18, a cam-operated credit release switch 20, and a cam-operated timer switch 22. The cam-operated switches 20 and 22 are arranged to be actuated by the corresponding motors 10 by means of motor-driven cams 24 which are driven by the corresponding vend motors 10 via connections represented by dash lines 26, and which cams 24 effect actual operation of the credit release switches 20 and the timer switches 22 through mechanical connections represented by respective dash lines 28 and 30.

The circuit additionally has a number of common components which are shared by all of the columns or sources. Specifically, there is a conventional coin mechanism 32 which includes a coin-operated vend switch or coin switch 34 having a common terminal connected to the hot line 6, a normally-closed (NC) contact terminal, and a normally-open (NO) contact terminal. In operation, upon insertion of the proper amount of money, the vend switch or coin switch 34 momentarily switches to its normally-open (NO) position, and then returns to the normally-closed (NC) position illustrated. The coin mechanism 32 additionally includes a conventional coin reject electromagnet 36 which, when energized, permits the acceptance of money to actuate the vend switch 34 and, when de-energized, prevents the acceptance of money. It will be appreciated that the coin mechanism 32 may be a conventional coin operated device adapted to receive coins of greater value than the cost of the article to be selected, and to dispense change accordingly, while momentarily closing the normally-open (NO) contacts when the proper amount of coins is received, and thereafter returning the contacts to their original position.

An additional element common to the various article columns is a conventional vend relay 38 including an operating coil 40 and contact sections 42 and 44.

To energize the vend relay 38 upon insertion of money, the normally-open (NO) terminal of the vend switch 34 is connected via a line 46 to an energization terminal 48 of the vend relay coil 40, and the other terminal 50 of the vend relay coil 40 is connected to the ground return line 8.

For establishing a holding circuit for the vend relay 38 upon initial energization thereof, the normally open (NO) terminal of the vend relay contact section 44 is connected via a line 52 to the vend relay energization terminal 48, while the common terminal of the vend relay contact section 44 is supplied by a line 54 which, in a manner hereinafter described, is energized through the credit release switches 20 at appropriate times.

In accordance with the invention, a credit release relay 56 includes an operating coil 58 which is energized when the vend relay 38 is energized. More particularly, a means for energizing the credit release relay 56 when the vend relay 38 is energized includes a connection through an isolation diode 60 between the vend relay coil energization terminal 48 and an energization terminal 62 of the credit release relay coil 58. To complete the circuit, the other terminal 64 of the credit release relay coil 58 is connected to the ground return line 8.

A time delay means, generally designated 66, is provided to maintain the credit release relay 56 energized for a predetermined time interval after the vend relay 38 is de-energized, the particular predetermined time interval being selected in a manner hereinafter described. To this end, the time delay means 66 in the particular embodiment illustrated includes a storage capacitor 68 connected in parallel with the coil 58 of the credit release relay 56. In order to better control the discharge characteristics of the capacitor 68, an optional current limiting resistor 70 is interposed in series therewith. Depending upon the internal resistance of the credit release relay coil 58, the resistor 70 may or may not be necessary. It will be appreciated, however, that other means may be employed to delay the de-energization of the credit release relay 56.

In the operation of the time delay means 66, when the vend relay 38 is energized, voltage across the coil 40 thereof is additionally supplied through the isolation diode 60 to energize the credit release relay coil 58. This voltage additionally charges the storage capacitor 68. Upon subsequent de-energization of the vend relay 38, and more particularly of the coil 40 thereof, voltage is no longer supplied from the vend relay 38 to the credit release relay coil 58 and the storage capacitor 68. The capacitor 68 discharges at a predictable rate through the current limiting resistor 70 and the credit release relay coil 58, thus maintaining the credit release relay 56 in an energized condition until insufficient charge remains in the capacitor 68. It will be appreciated that the isolation diode 60 serves to prevent discharge of the holding capacitor 68 into the vend relay coil 40, which discharge otherwise would cause a delay in the release of the vend relay 38 as well.

In addition to its isolation function, it will be appreciated that, in the event the circuit is operated from an A.C. source, the diode 60 additionally serves as a rectifier diode. In this event, all of the circuit components with the exception of the credit release relay 56 and its associated capacitor 68 and resistor 70 would operate on A.C. power. In particular, the vend relay coil 40 would operate on A.C. power, and the credit release relay coil 58 would operate on recitifed D.C. power.

The components associated with each of the individual article columns will now be described in greater detail. In order to supply the selector switches 12 with power when the vend relay 38 is energized, the common terminal of the vend relay contact section 42 is connected via a line 76 to the selector switches 12, and the normally-open (NO) terminal of the vend relay contact section 42 is connected, in an "anti-jackpot" feature, via the line 78 to the normally-closed (NC) contact terminal of the vend switch 34. Thus voltage from the hot line 6 is supplied through the vend relay contact section 42 to the line 76 and the selector switches 12 only after the coin switch or vend switch 34 has returned to the normally-closed (NC) position illustrated.

The particular arrangement of the selector switches 12 is such that upon simultaneous customer operation of a plurality of the selector switches 12 only one selector switch energizes its corresponding vend motor 10. To this end, the line 76 supplies the selector switches 12 in serial fashion. Specifically, the common terminal of the selector switch 12C is directly supplied from the line 76, the common terminal of the selector switch 12B is supplied via a line 80 connected to the normally-closed (NC) terminal of the selector switch 12C, and the common terminal of the selector switch 12A is supplied via a line 82 from the normally-closed (NC) terminal of the selector switch 12B. Thus if more than one selector switch 12 is operated at a time, only the higher one in the chain remains supplied with power.

In the particular connection, referred to above, of each selector switch 12 to energize the corresponding vend motor 10 when operated while supplied with power, the normally-open (NO) terminal of each of the selector switches 12 is connected via a line 84 to the common terminal of the corresponding sold out switch first section 14, and then from the switch section 14 normally-closed (NC) terminal via a line 86 directly to an energization terminal 87 of the corresponding vend motor 10. To complete this energization circuit, the other terminals of the vend motors 10 are connected directly to the ground return line 8.

In the event a particular column is sold out, then the contact sections 14 and 16 of the associated sold out switch are in the normally-open (NO) position. When this occurs, the connection between the lines 84 and 86 is broken such that the corresponding vend motor 10 cannot operate when the selector switch 12 is operated, and the corresponding sold out light 18 is energized from the hot line 6 through a path including the now-closed normally-open (NO) contacts of the second sold out switch section 16, a line 88, and the now-closed normally-open (NO) contacts of the first sold out switch section 14.

An additional function of the sold out switch second sections 16 is to supply a line 90, common to all article selections, which is connected to the common terminal of the credit release relay contacts 92. The normally-closed (NC) contact terminals of the second sold out switch sections 16 are connected in parallel such that the line 90 is supplied from the hot line 6 so long as at least one of the article sources is not exhausted and the corresponding sold out switch remains in the normally-closed (NC) position, and power is removed from the line 90 when the vending machine is completely sold out.

To energize the reject electromagnet 36 (permitting the acceptance of money) when the credit release relay 56 is de-energized, a line 93 connects the credit release relay 56 normally-closed (NC) contact terminal to the reject electromagnet 36. This particular connection ensures that the reject electromagnet 36 cannot be energized when the machine is entirely sold out and power is removed from the line 90.

The cam-operated credit release switches 20 and the cam-operated time switches 22 will now be considered in greater detail. Both of these switches are for convenience operated from the single cam 24 via the mechanical links represented at 28 and 30. Each of the cam-operated switches has a normally-closed (NC) position which occurs when the appropriate mechanical link 28 or 30 is in a corresponding cam notch 94, and has a normally-open (NO) position which occurs when the mechanical link 28 or 30 is on the high part of the cam 24. In the "at rest" position illustrated in the drawing, the mechanical links 28 of the credit release switches 20 are all on the high parts of the corresponding cams 24, and the credit release switches 20 are accordingly in the normally-open (NO) position, hereinafter referred to as a first position of each of the credit release switches 20. In the "at rest" position, the mechanical links 30 of the timer switches 22 are in the notches 94 of the cams 24 such that the timer switches 22 are all in the normally-closed (NC) position, hereinafter referred to as the first position of the timer switches 22.

Each of the credit release switches 20 is arranged to be actuated by its corresponding vend motor 10 via the cam 24 and link 28 between the normally-open (NO) or first position illustrated and a momentary normally-closed (NC) or second position which occurs shortly after initial energization of the corresponding vend motor 10 by the corresponding selector switch 12. The credit release switches 20 are all initially supplied with power when the credit release relay 56 is energized and the credit release relay contacts 92 switch to their normally-open (NO) position whereby a line 96 is supplied with power from the line 90. This supplies power to the common terminal of the credit release switch 20C uppermost in the illustration, which switch, via a series arrangement of the normally open (NO) contacts of the credit release switches 20 supplies power to the remaining credit release switches 20.

In the normally-open (NO) or first credit release switch position shown in the drawing, a continuous conductive path may be traced from the credit release relay contacts 92 through the line 96, through the credit release switch 20C, through a line 98, through the credit release switch 20B, through a line 100, and then through the credit release switch 20A to the previously mentioned line 54 which supplies the vend relay 38 holding circuit. Thus when the credit release switches 20 are all in the first position as illustrated, the vend relay 38 holding circuit is energized, awaiting actual energization of the vend relay 38 by the vend switch 34.

The contacts of each of the credit release switches 20 are additionally arranged in the momentary normally-open (NO) or second position to interrupt the vend relay holding circuit, allowing the vend relay 38 to become de-energized. Due to the series connection of the credit release switch normally-open (NO) contacts, switching of any one of the credit release switches 20 to the second position wherein the normally-closed (NC) contacts are open interrupts the vend relay 38 holding circuit.

The switching of any one of the credit release switches 20 to the second position wherein the normally-closed (NC) contacts are closed additionally energizes the corresponding vend motor 10 so long as the particular credit release switch 20 remains supplied with power.

As a part of the circuit which ensures the delivery of only one article per vend switch 34 operation, at least one of the credit release switches 20 in its momentary second position wherein the normally-closed (NC) contacts are closed interrupts the supply of power to at least one other credit release switch 20, which may also be in its second position as a result of a customer attempt to obtain more than one article from the deposit of a single coin. By way of example, when the uppermost credit release switch 20C is in the second position wherein its normally-closed (NC) contacts are closed and its normally-open (NO) contacts are open, power from the line 96 to the line 98 is interrupted, and the two lower credit release switches 20B and 20A are no longer supplied with power. Accordingly these two lower credit release switches 20B and 20A do not energize their corresponding vend motors 10B and 10A even though they may also be in their second positions wherein the normally-closed (NC) contacts are closed.

The cam arrangement for the timer switches 22 is such that each of the timer switches 22 is actuated by its corresponding motor 10 from the first to the second position wherein the normally-open (NO) contacts are closed during the interval the corresponding credit release switch 20 is in its momentary second position energizing the corresponding vend motor 10. Each timer switch 22 is further arranged to be actuated from the second back to the first position at the end of an article vend cycle.

From the representative depiction of each of the cams 24, it will be seen that initially the representative links 28 are on the high part of the cams 24, and the mechanical links 30 are in the cam notches 94. Thus the credit release switches 20 are in the normally-open (NO) position (first position) and the timer switches 22 are in the normally-closed (NC) position (first position). When one of the vend motors 10 is energized and the corresponding one of the cams 24 rotates clockwise, almost immediately the corresponding mechanical link 28 enters the notch 94, while the mechanical link 30 initially remains in the notch 94. The credit release switch 20 thus switches to its second position wherein the normally-closed (NC) contacts are closed, while the timer switch 22 remains in the first position illustrated. As the cam 24 continues its clockwise rotation, the raised part of the cam reaches the mechanical link 30 which actuates the timer switch 22 to its second position wherein its normally-open (NO) contacts are closed. Shortly thereafter, the mechanical link 28 is also on the high part of the cam 24, and the credit release switch 20 returns to its first or normally-open (NO) switch position. At the end of a vend cycle, the link 30 of the timer switch 22 again enters the cam notch 94, terminating the vend cycle.

The normally-open (NO) contact terminals of each of the timer switches 22 are supplied from the line 90 which is directly connected via a sold out switch section 16 to the hot line 6 so long as at least one of the article sources is not yet exhausted. Accordingly, actuation of a timer switch 22 to the second position wherein its normally-open (NO) contacts are closed effects direct energization of the corresponding vend motor 10, which energization continues until the end of the vend cycle, whereupon the timer switch returns to its first position, de-energizing the vend motor 10.

As previously mentioned, the time delay means 66 maintains the credit release relay 56 energized for a predetermined time interval after the vend relay 38 holding circuit is interrupted and the vend relay 38 is de-energized. This predetermined time interval is at least long enough for whichever one of the timer switches 22 is active to switch to its second position and directly energize the corresponding vend motor 10, and short enough such that the credit release relay 56 is de-energized to remove the supply of power via the line 96 from all of the credit release switches 20 before the vend motor 10 corresponding to any other credit release switch which may be in its second position is energized sufficiently long to cause the corresponding other timer switch 22 to switch to second position.

In the overall operation of the present vending machine control circuit, upon insertion of the correct amount of money, the vend switch or coin switch 34 momentarily switches to its normally-open (NO) position and momentarily energizes the vend relay 38 through the conductor 46. Power is additionally simultaneously supplied through the isolation diode 60 to energize the credit release relay 56. The vend relay 38 holding circuit is thereby established, which holding circuit may be traced from the hot line 6, through any one of the sold out switch second sections 16, through the line 90, through the now-closed normally-open (NO) contacts 92 of the credit release relay 56, through the series connected credit release switches 20, through the line 54, and then through the now-closed normally-open (NO) contacts 44 of the vend relay 38. Upon customer actuation of a selector switch, for example the selector switch 12B, assuming the corresponding sold out switch 14B is in its normally-closed (NC) position, a direct energization path to the energization terminal 87B of the vend motor 10B is established. The cam 24B begins rotating in the clockwise direction as illustrated, and the credit release switch 20B almost immediately switches to its second position wherein the normally-closed (NC) contacts are closed. In this particular arrangement, it will be appreciated that the selector switch 12B must be held in its momentary normally-open (NO) position to energize the vend motor 10B until such time as the credit release swithch 20B has switched to its second position.

At this point, the credit release switch 20B interrupts the vend relay 38 holding circuit as the credit release switch 20B normally-open (NO) contacts open. The vend relay 38 immediately returns to its de-energized condition, removing power from all of the selector switches 12 which are supplied through the line 76. Additionally, the credit release switch 20B switching to the second position interrupts the supply of power to the next lower credit release 20A, even though the credit release relay 56 remains energized due to the time delay means 66.

With further clockwise rotation of the cam 24B, the timer switch 22B switches to its second position wherein its normally-open (NO) contacts are closed. This establishes a direct energization path for the corresponding vend motor 10B, which rotates the cam 24B all the way around until the timer switch 22B again returns to its first position and de-energizes the vend motor 10B.

In the meantime, the time delay means 66 de-energizes the credit release relay 56, whereupon the credit release relay 56 normally-closed (NC) contacts 92 again close, and the normally-open (NO) contacts open removing power from all of the credit release switches 20. This has the effect of removing established credit and readying the circuit to receive the next insertion of money.

The present vending machine control circuit also deals effectively with various abnormal conditions. One abnormal condition is a machine jam wherein a vend motor 10 is stalled. Since actual product dispensing occurs after the timer switch 22 switches to its second position and the credit release switch 20 returns to its first position, a jam during product dispensing affects only the article column or source corresponding to that one particular vend motor. Once the credit release switch 20 has returned to its first position wherein its normally-open (NO) contacts are again closed and the time delay means 66 allows the credit release relay 56 to de-energize, the inventive circuit is again ready to accept additional money and permit other article selections. In this condition, a subsequent customer is warned not to select the stalled article source because the corresponding sold out light 18 is energized through the line 86, the first sold out switch section 14 and the line 84.

As previously mentioned, a form of protection, previously known in the art, against multiple product selection after a single insertion of money is provided by the series connection of the selector switches 12 such that, upon simultaneous customer operation of a plurality of the selector switches 12, only one selector switch 12 energizes its corresponding vend motor 10.

Nevertheless, a customer may attempt to defeat the circuit by rapid alternate operation of more than one of the selector switches 12. Due to a certain amount of rotational inertia, a vend motor 10 may continue to rotate slightly even after it is de-energized, and, depending upon the precise adjustment of the various cams and the tolerances of the particular components employed, it is possible that a customer may succeed in having two of the vend motors 10 rotate their associated cams 24 to a point where more than one of the credit release switches 20 are in their second positions. Additionally, due to the mechanical nature of the components, there is a momentary delay between the time the vend relay coil 40 is de-energized and the time when its normally-open (NO) contacts of section 42 actually physically open.

Assuming that a customer has succeeded in achieving this condition and that, for example, the uppermost credit release switch 20C and the middle credit release switch 20B are both in their second positions, it will be seen that the upper credit release switch 20C removes power from the next lower credit release switch 20B. Thus initially only the vend motor 10C continues to rotate, and the product selection associated with the vend motor 10C continues normally. However, upon return of the credit release switch 20C to its first position wherein its normally-open (NO) contacts are closed, the next lower credit release switch 20B is again energized, permitting the vend motor 10B to resume rotation. As a result of the predetermined time delay of the time delay means 66, substantially at this point the credit release relay 56 is de-energized, removing power from the credit release switches 20, and particularly the credit release switch 20B, preventing further rotation of the vend motor 10B. It will be appreciated that the predetermined time delay is selected such that the rotation of the vend motor 10B does not proceed far enough for the timer switch 22B to switch to its second position which would have the effect of directly energizing the vend motor 10B, and thus undesirably permitting multiple product dispensing.

From the foregoing it will be apparent that the present invention provides a vending machine control circuit having desirable lockout features at a minimum of cost and complexity. In particular, only two cam-operated switches for each product selection are required, with a single credit release relay 56 common to all product selections. Thus an overall savings is realized, compared to circuits which require three cam-operated switches for each product selection, when a large plurality, for example eight, of different product selections are offered.

While a specific embodiment of the invention has been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A control circuit for a vending machine having a plurality of sources of articles adapted to be selectively dispensed and a plurality of vend motors, each vend motor corresponding to a separate source and arranged to dispense an article from the corresponding source when energized according to the choice of a customer, said control circuit comprising:

a vend relay;

means for establishing a holding circuit for said vend relay upon energization thereof;

a vend switch connected to momentarily energize said vend relay upon insertion of money;

a credit release relay;

means for energizing said credit release relay when said vend relay is energized;

a customer-operable selector switch for each article source, said selector switches being supplied with power when said vend relay is energized, and each of said selector switches connected to energize the corresponding vend motor when operated while supplied with power;

a credit release switch for each vend motor arranged to be actuated by its corresponding vend motor between a first and a momentary second position shortly after initial energization of the corresponding vend motor by the corresponding selector switch, each credit release switch being supplied with power when said credit release relay is energized, and each credit release switch having contacts arranged in the first position to energize said vend relay holding circuit, and arranged in the momentary second position to interrupt said vend relay holding circuit and to maintain energization of the corresponding vend motor while supplied with power, and at least one of said credit release switches in its momentary second position interrupting the supply of power to at least one other credit release switch which may also be in its second position;

a timer switch for each vend motor arranged to be actuated by its corresponding motor from a first to a second position during the interval the corresponding credit release switch is in its momentary second position to maintain energization of the corresponding vend motor, and to be actuated from the second to the first position at the end of an article vend cycle, each timer switch having contacts arranged in the second position to maintain energization of the corresponding vend motor and arranged upon return to the first position to de-energize the corresponding vend motor; and time delay means for maintaining said credit release relay energized for a predetermined time interval after said at least one credit release switch interrupts the supply of power to said other credit release switches and interrupts said vend relay holding circuit to de-energize said vend relay, the predetermined time interval being at least long enough for the corresponding one timer switch to switch to its second position and maintain energization of the corresponding vend motor, and short enough such that said credit release relay is de-energized thus removing the supply of power from all credit release switches before the vend motor corresponding to any of said other credit release switches is energized sufficiently long enough to cause the corresponding other timer switches to switch to their second position in the event any of said other credit release switches is in its second position, whereby delivery of only one article per vend switch operation is ensured.

2. A vending machine control circuit according to claim 1, wherein said time delay means comprises a storage capacitor connected in parallel with the coil of said credit release relay.

3. A vending machine control circuit according to claim 2, which further comprises an isolation diode connected between an energization terminal of the vend relay coil and an energization terminal of the credit release relay coil such that current flows through said diode to energize said credit release relay and charge said capacitor when said vend relay is energized, and current flow from said capacitor to said vend relay coil is prevented when said vend relay is de-energized.

4. A vending machine control circuit according to claim 1, which further comprises:

a reject electromagnet which when energized permits the acceptance of money to actuate said vend switch and which when de-energized prevents the acceptance of money; and means for energizing said reject electromagnet when said credit release relay is de-energized.

5. A vending machine control circuit according to claim 1, wherein said selector switches are arranged such that upon simultaneous customer operation of a plurality of selector switches only one selector switch energizes the corresponding vend motor.

* * * * *